US009799956B2

(12) United States Patent
Orsi et al.

(10) Patent No.: US 9,799,956 B2
(45) Date of Patent: Oct. 24, 2017

(54) THREE-DIMENSIONAL COMPOUND LOOP ANTENNA

(71) Applicant: DOCKON AG, Zurich (CH)

(72) Inventors: Ryan James Orsi, San Diego, CA (US); Matthew Robert Foster, San Diego, CA (US)

(73) Assignee: DOCKON AG, Zurich (CH)

( * ) Notice: Subject to any disclaimer, the term of this patent is extended or adjusted under 35 U.S.C. 154(b) by 119 days.

(21) Appl. No.: 14/103,684

(22) Filed: Dec. 11, 2013

(65) Prior Publication Data

US 2015/0162660 A1 Jun. 11, 2015

(51) Int. Cl.

| | |
|---|---|
| ***H01Q 7/00*** | (2006.01) |
| ***H01Q 9/28*** | (2006.01) |
| ***H01Q 9/42*** | (2006.01) |
| *H01Q 1/22* | (2006.01) |

(52) U.S. Cl.

CPC ..... *H01Q 7/00* (2013.01); *H01Q 9/28* (2013.01); *H01Q 9/285* (2013.01); *H01Q 9/42* (2013.01); *H01Q 1/2233* (2013.01)

(58) Field of Classification Search

CPC ..... H01Q 7/00
USPC ..... 343/848
See application file for complete search history.

(56) References Cited

U.S. PATENT DOCUMENTS

| | | | | |
|---|---|---|---|---|
| 4,992,799 | A | 2/1991 | Garay | |
| 5,212,494 | A * | 5/1993 | Hofer | H01Q 11/105 343/792.5 |
| 5,952,982 | A * | 9/1999 | Jorgenson | H01Q 11/10 343/792.5 |
| 6,300,914 | B1 | 10/2001 | Yang | |
| 6,307,509 | B1 * | 10/2001 | Krantz | H01Q 1/38 343/700 MS |
| 6,344,736 | B1 | 2/2002 | Kerrigan et al. | |
| 7,030,819 | B2 * | 4/2006 | Horibe | H01Q 1/007 343/702 |
| 8,115,683 | B1 | 2/2012 | Stefanakos et al. | |
| 8,144,065 | B2 * | 3/2012 | Brown | H01Q 9/14 343/726 |
| 8,149,173 | B2 | 4/2012 | Brown | |
| 8,164,532 | B1 | 4/2012 | Brown et al. | |
| 8,253,555 | B2 | 8/2012 | Stevenson et al. | |

(Continued)

FOREIGN PATENT DOCUMENTS

| | | |
|---|---|---|
| CN | 101849318 A | 9/2010 |
| EP | 1753080 A1 | 2/2007 |

(Continued)

OTHER PUBLICATIONS

International Patent Application No. PCT/US2014/69627; Int'l Preliminary Report on Patentability; dated Dec. 11, 2015; 19 pages.

(Continued)

*Primary Examiner* — Dameon E Levi
*Assistant Examiner* — Walter Davis
(74) *Attorney, Agent, or Firm* — Baker & Hostetler LLP

(57) ABSTRACT

A three-dimensional compound loop antenna is provided, including a ground plane, a pair of horizontal conductive portions substantially horizontal relative to the ground plane, a feed line substantially vertical relative to the ground plane, and a vertical conductive portion coupling the pair of horizontal conductive portions to the ground plane.

20 Claims, 18 Drawing Sheets

(56) References Cited

U.S. PATENT DOCUMENTS

| | | | | |
|---|---|---|---|---|
| 8,259,014 | B2 | 9/2012 | Wu | |
| 8,350,770 | B1 * | 1/2013 | Dawson | H01Q 1/48 343/700 MS |
| 8,502,546 | B2 | 8/2013 | Nyshadham et al. | |
| 8,933,853 | B2 | 1/2015 | Asanuma et al. | |
| 2002/0077160 | A1 | 6/2002 | Edwards et al. | |
| 2005/0057405 | A1 | 3/2005 | Horibe | |
| 2005/0243005 | A1 * | 11/2005 | Rafi | H01Q 9/0442 343/767 |
| 2007/0139285 | A1 | 6/2007 | Maruyama et al. | |
| 2007/0285321 | A1 | 12/2007 | Chung et al. | |
| 2009/0073048 | A1 * | 3/2009 | Kim | H01Q 1/243 343/700 MS |
| 2009/0121947 | A1 | 5/2009 | Nysen | |
| 2009/0207092 | A1 | 8/2009 | Nysen et al. | |
| 2010/0117926 | A1 | 5/2010 | DeJean, II | |
| 2010/0171563 | A1 * | 7/2010 | Dupuy | H01P 1/15 333/103 |
| 2011/0018775 | A1 | 1/2011 | Brown | |
| 2011/0018776 | A1 | 1/2011 | Brown | |
| 2011/0018777 | A1 | 1/2011 | Brown | |
| 2011/0032165 | A1 | 2/2011 | Heng et al. | |
| 2011/0156852 | A1 | 6/2011 | Unno | |
| 2012/0038519 | A1 | 2/2012 | Su | |
| 2012/0056790 | A1 | 3/2012 | Lee et al. | |
| 2012/0256808 | A1 | 10/2012 | Owens | |
| 2012/0258661 | A1 | 10/2012 | Nakayama et al. | |
| 2012/0326941 | A1 | 12/2012 | Su et al. | |
| 2013/0057440 | A1 | 3/2013 | Brown et al. | |
| 2013/0057441 | A1 | 3/2013 | Brown et al. | |
| 2013/0113666 | A1 | 5/2013 | Orsi et al. | |
| 2013/0187674 | A1 | 7/2013 | Rada et al. | |
| 2013/0288618 | A1 | 10/2013 | Becker et al. | |
| 2014/0022142 | A1 | 1/2014 | Brown et al. | |
| 2014/0302800 | A1 | 10/2014 | Manssen et al. | |
| 2015/0303556 | A1 | 10/2015 | Flores-Cuadras et al. | |

FOREIGN PATENT DOCUMENTS

| | | | |
|---|---|---|---|
| TW | 201347295 | A | 11/2013 |
| WO | WO 2006/022046 | A1 | 3/2006 |
| WO | WO 2009/118565 | A1 | 10/2009 |
| WO | WO 2010/023503 | A1 | 3/2010 |
| WO | WO 2011/100618 | A1 | 8/2011 |

OTHER PUBLICATIONS

International Patent Application No. PCT/US2015/30667; Int'l Search Report and the Written Opinion; dated Aug. 20, 2015; 11 pages.

International Patent Application No. PCT/US2014/69414; Int'l Preliminary Report on Patentability; dated Jan. 19, 2016; 22 pages.

International Patent Application No. PCT/US2016/019933; Int'l Search Report and the Written Opinion; dated May 2, 2016; 23 pages.

* cited by examiner

THREE-DIMENSIONAL COMPOUND LOOP ANTENNA

TECHNICAL FIELD

The technical field generally relates to antennas and more specifically relates to three-dimensional antennas.

BACKGROUND

As new generations of cellular phones and other wireless communication devices become smaller and embedded with increased applications, new antenna designs are required to address inherent limitations of these devices and to enable new capabilities. With conventional antenna structures, a certain physical volume is required to produce a resonant antenna structure at a particular frequency and with a particular bandwidth. However, effective implementation of such antennas is often confronted with size constraints due to a limited available space in the device.

Antenna efficiency is one of the important parameters that determine the performance of the device. In particular, radiation efficiency is a metric describing how effectively the radiation occurs, and is expressed as the ratio of the radiated power to the input power of the antenna. A more efficient antenna will radiate a higher proportion of the energy fed to it. Likewise, due to the inherent reciprocity of antennas, a more efficient antenna will convert more of a received energy into electrical energy. Therefore, antennas having both good efficiency and compact size are often desired for a wide variety of applications.

Conventional loop antennas are typically current fed devices, which generate primarily a magnetic (H) field. As such, they are not typically suitable as transmitters. This is especially true of small loop antennas (i.e. those smaller than, or having a diameter less than, one wavelength). The amount of radiation energy received by a loop antenna is, in part, determined by its area. Typically, each time the area of the loop is halved, the amount of energy which may be received is reduced by approximately 3 dB. Thus, the size-efficiency tradeoff is one of the major considerations for loop antenna designs.

Voltage fed antennas, such as dipoles, radiate both electric (E) and H fields and can be used in both transmit and receive modes. Compound loop (CPL) antennas are those in which both the transverse magnetic (TM) and transverse electric (TE) modes are excited, resulting in performance benefits such as wide bandwidth (lower Q), large radiation intensity/power/gain, and good efficiency. There are a number of examples of two dimensional, non-compound antennas, which generally include printed strips of metal on a circuit board. Most of these antennas are voltage fed. An example of one such antenna is the planar inverted F antenna (PIFA). A large number of antenna designs utilize quarter wavelength (or some multiple of a quarter wavelength), voltage fed, dipole antennas.

SUMMARY

Disclosed herein are three-dimensional compound loop antennas. In an embodiment, an antenna may include a ground plane, a pair of horizontal conductive portions substantially horizontal relative to the ground plane, a feed line substantially vertical relative to the ground plane and coupled with the pair of horizontal conductive portions, and a vertical conductive portion coupling the pair of horizontal conductive portions to the ground plane. The pair of horizontal conductive portions may include a first horizontal conductive portion and a second horizontal conductive portion.

In an embodiment, an antenna may include a ground plane, a first pair of horizontal conductive portions substantially horizontal relative to the ground plane, a second pair of horizontal conductive portions substantially horizontal relative to the ground plane, a feed line substantially vertical relative to the ground plane and coupled with the first pair of horizontal conductive portions and the second pair of horizontal conductive portions, a first vertical conductive portion coupling the first pair of horizontal conductive portions to the ground plane, and a second vertical conductive portion coupling the second pair of horizontal conductive portions to the ground plane. The first pair of horizontal conductive portions may include a first horizontal conductive portion and a second horizontal conductive portion. The second pair of horizontal conductive portions may comprise a third horizontal conductive portion and a fourth horizontal conductive portion.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to limitations that solve any or all disadvantages noted in any part of this disclosure.

BRIEF DESCRIPTION OF THE DRAWINGS

A more detailed understanding may be had from the following description, given by way of example in conjunction with the accompanying drawings wherein.

DETAILED DESCRIPTION OF ILLUSTRATIVE EMBODIMENTS

In view of the known limitations associated with conventional antennas, in particular with regard to the radiation efficiency, a compound loop antenna (CPL), also referred to as a modified loop antenna, has been devised to provide both transmit and receive modes with greater efficiency than a conventional antenna with a comparable size. Examples of structures and implementations of the CPLs are provided in U.S. Pat. No. 8,144,065 issued on Mar. 27, 2012, U.S. Pat. No. 8,149,173 issued on Apr. 3, 2012, and U.S. Pat. No. 8,164,532 issued on Apr. 24, 2012. The contents of the above patents are incorporated herein by reference, and key features of the CPLs are summarized below.

Figure 1:
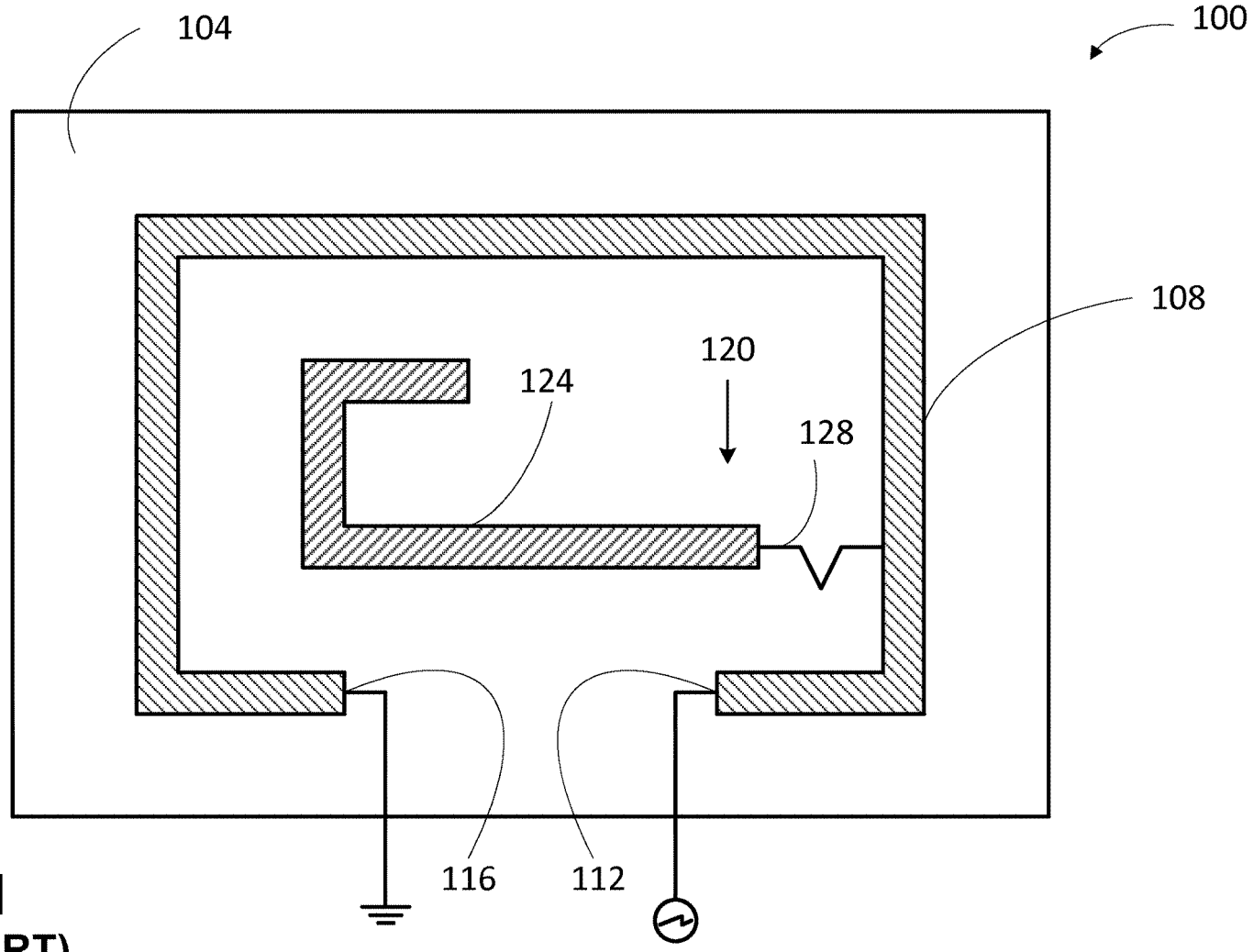
FIG. 1 (PRIOR ART)
FIG. 1 illustrates a prior art embodiment of a planar CPL antenna.

FIG. 1 illustrates a prior art embodiment of a planar CPL antenna 100, such as illustrated and described in commonly assigned U.S. Pat. No. 8,149,173, the entirety of which is incorporated herein by reference. In this embodiment, the planar CPL antenna 100 is printed on a printed circuit board (PCB) 104, and includes a loop element 108, which in this case is formed as a trace along rectangle edges with an open base portion providing two end portions 112 and 116. One end portion 112 is a feed point of the antenna where the current is fed. The other end portion 116 is shorted to ground. Transmission lines can be used to be connected to the two end portions 112 and 116 in a known manner. The CPL antenna 100 further includes a radiating element 120 that has a J-shaped trace 124 and a meander trace 128. In this embodiment, the meander trace 128 is configured to couple the J-shaped trace 124 to the loop element 108. The radiating element 120 essentially functions as a series resonant circuit providing an inductance and a capacitance in series, and their values are chosen such that the resonance occurs at the frequency of operation of the antenna. Instead of using the meander trace 128, the shape and dimensions of the J-shaped trace 124 may be adjusted to connect directly to the loop element 108 and still obtain the target resonance.

Similar to a conventional loop antenna that is typically current fed, the loop element 108 of the planar CPL antenna 100 generates a magnetic (H) field. The radiating element 120, having the series resonant circuit characteristics, effectively operates as an electric (E) field radiator (which of course is an E field receiver as well due to the reciprocity inherent in antennas). The connection point of the radiating element 120 to the loop element 108 helps the planar CPL antenna 100 to generate/receive the E and H fields that are substantially orthogonal to each other. This orthogonal relationship has the effect of enabling the electromagnetic waves emitted by the antenna to effectively propagate through space. In the absence of the E and H fields being arranged orthogonal to each other, the waves will not propagate effectively beyond short distances. To achieve this effect, the radiating element 120 is placed at a position where the E field produced by the radiating element 120 is 90° or 270° out of phase relative to the H field produced by the loop element 108. Specifically, the radiating element 120 is placed at the substantially 90° (or 270°) electrical length along the loop element 108 from the feed point 112. Alternatively, the radiating element 120 may be connected to a location of the loop element 108 where current flowing through the loop element 108 is at a reflective minimum.

In addition to the orthogonality of the E and H fields, it is desirable that the E and H fields are comparable to each other in magnitude. These two factors, i.e., orthogonality and comparable magnitudes, may be appreciated by looking at the Poynting vector (vector power density) defined by $P=E\times H$ (Watts/$m^2$=Volts/m×Amperes/m). The total radiated power leaving a surface S surrounding the antenna is found by integrating the Poynting vector over the surface S. Accordingly, the quantity $E\times H$ is a direct measure of the radiated power, and thus the radiation efficiency. First, it is noted that when the E and H are orthogonal to each other, the vector product is at a maximum value. Second, since the overall magnitude of a product of two quantities is limited by the smaller value, having the two quantities ($|H|$ and $|E|$ in this case) as close as possible gives the optimal product value. As explained above, in the planar CPL antenna, the orthogonally of the fields is achieved by placing the radiating element 120 at the substantially 90° (or 270°) electrical length along the loop element 108 from the feed point 112. Furthermore, the shapes and dimensions of the loop element 108 and the radiating element 120 can be each configured to provide comparable high $|H|$ and $|E|$ in magnitude, respectively. Therefore, in marked contrast to a conventional loop antenna, the planar CPL antenna can be configured not only to provide both transmit and receive modes, but also to increase the radiation efficiency.

Figure 2B:
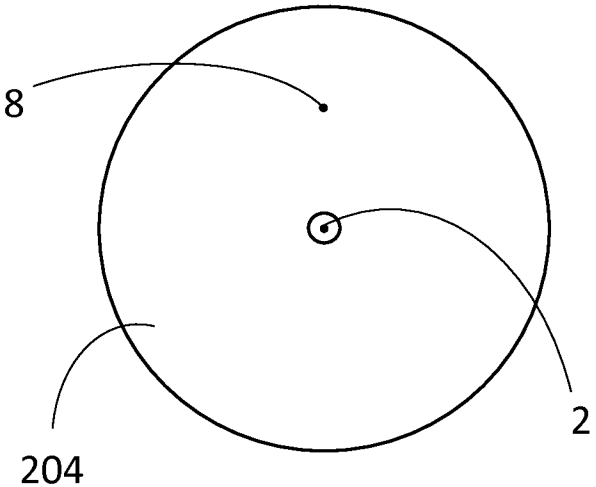
FIG. 2B illustrates a bottom view of the 3D CPL antenna structure illustrated in FIG. 2A.
Figure 2A:
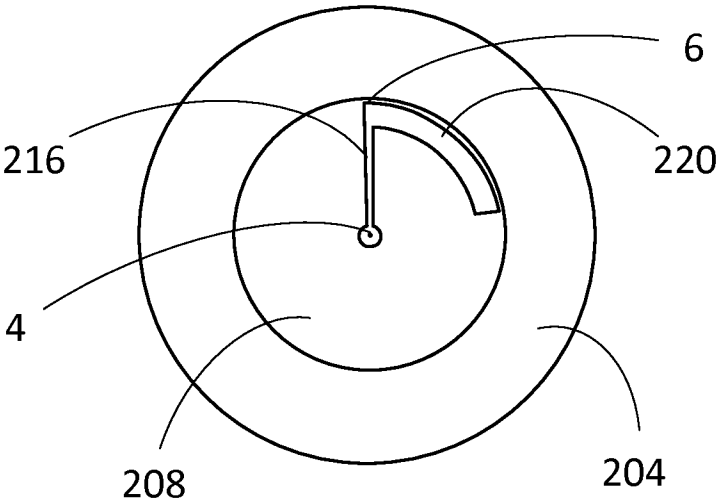
FIG. 2A illustrates a top view of an embodiment of a 3D CPL antenna structure.
Figure 2C:
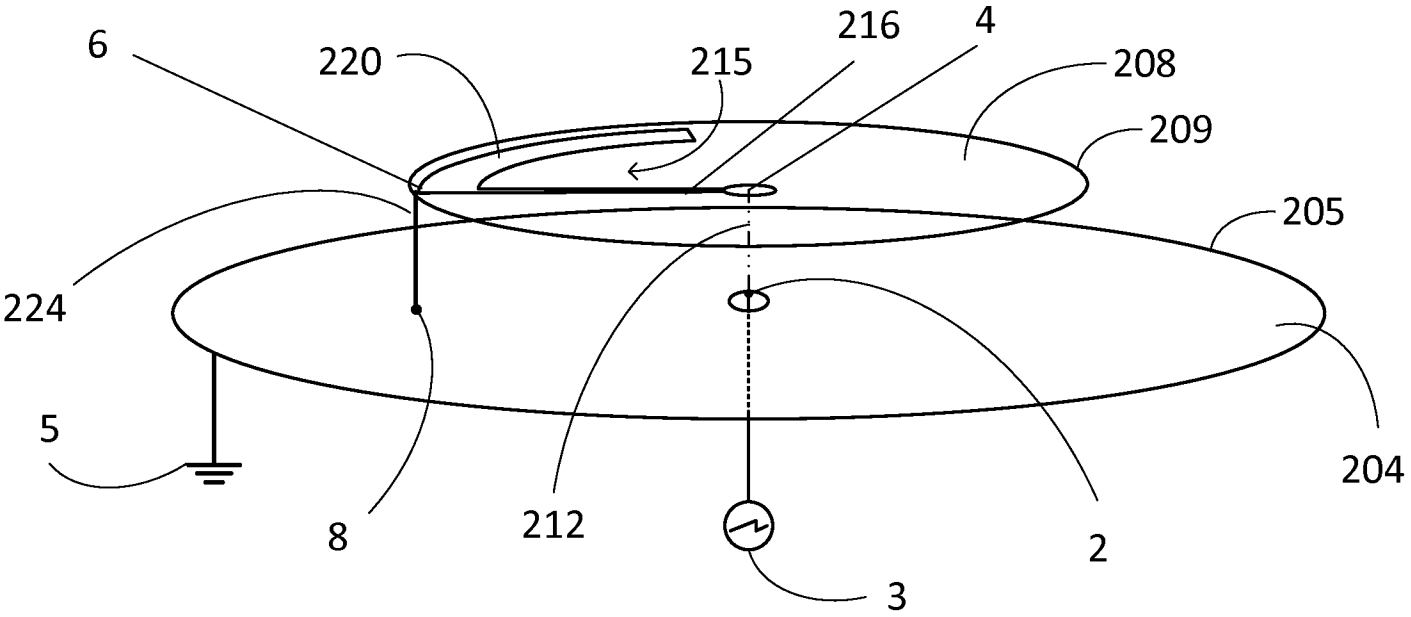
FIG. 2C illustrates a front perspective view of the 3D CPL antenna structure illustrated in FIG. 2A.

The three-dimensional (3D) CPL embodiments disclosed herein may have similar operational characteristics to the prior art antenna described in FIG. 1, but involve markedly different structure for obtaining such functionality. FIGS. 2A, 2B and 2C illustrate an embodiment of a 3D CPL antenna structure: FIG. 2A is a top view, FIG. 2B is a bottom view and FIG. 2C is a front perspective view. Conductive patches and traces are shown by shading in the figures. This 3D CPL antenna includes a ground plane 204 on a first horizontal plane (X-Y plane) and having a first outer circumference 205, as well as horizontal conductive portion or part printed on a substrate 208 on a second horizontal plane and having a second outer circumference 209. The first horizontal plane and the second horizontal plane are different and the first outer circumference 205 may be larger than the second outer circumference. The substrate 208 may be made of a dielectric material such as a PCB, ceramic, alumina, etc., and the ground plane may be formed on a similar dielectric material.

The 3D CPL antenna further includes vertical conductive portions that may be formed substantially vertical (along Z direction) to the ground plane 204 and the substrate 208. In this embodiment, each of the ground plane 204 and the dielectric substrate 208 may be configured to have a shape of a circular disk, and the diameter of the ground plane 204 may be set to be larger than the diameter of the substrate 208. The ground plane 204 and the substrate 208 are placed substantially in parallel and concentric to each other around the common cylindrical axis, which is also a vertical axis (Z axis) for the embodiment illustrated in FIGS. 2A-2C.

A current source 3 is coupled to a feed point 2, which may be located substantially at the center of but isolated from the ground plane 204. A feed line 212 may be formed vertically along a cylindrical axis between the ground plane 204 and the substrate 208, coupling the feed point 2 to a point 4, which may be located substantially at the center of the substrate 208. The feed line 212 passes through the ground plane 204 from the current source 3 on a first side of the ground plane 204 to the feed point 2 and on to the point 4 on the other side of the ground plane 204. A pair of horizontal conductive portions 215 including a first horizontal conductive portion 216 and a second horizontal conductive portion 220 are formed on the substrate 208. The first horizontal conductive portion 216 may have a first end coupled to the feed line 212 around the point 4, and may extend radially to a second end at a point 6, which may be located close to the edge of the substrate 208. The second horizontal conductive portion 220 may be coupled to the first horizontal conductive portion 216 at an end near point 6, and may extend azimuthally along a periphery of the substrate 208 to span at an angle. Thus, in this example, the first and second horizontal conductive portions 216 and 220 may together form the pair of horizontal conductive portions having a shape similar to that of a bent arm or a scythe formed (e.g., printed) on the substrate 208. A first end of a vertical conductive portion 224 may be coupled to the first and second horizontal conductive portions 216 and 220 to the second end of first conductive portion 216 around the point 6, and the second end of the vertical conductive portion 224 may be shorted to the ground plane 204 around a point 8. An alternative capacitive grounding technique is further described below.

By comparing the antenna structure illustrated in FIGS. 2A, 2B and 2C with the planar CPL antenna structure 100 illustrated in FIG. 1, identifications can be made topologically such that the conductive path including the feed line 212, the first horizontal conductive portion 216 and the vertical conductive portion 224, which couple the point 2, point 4, point 6, and point 8, correspond to the loop element 108 primarily generating the H field; and the second horizontal conductive portion 220 corresponds to the radiating element 120 primarily generating the E field. Despite the three-dimensional structure of the 3D CPL disclosed in FIGS. 2A, 2B and 2C, the three-dimensional structure does not result in the H field being orthogonal to the E field. In a manner similar to that of the planar CPL antenna disclosed in FIG. 1, in order for the E and H fields to be substantially orthogonal to each other, the second horizontal conductive portion 220 (radiating element) needs to be coupled to conductive portion 216 near point 6, which is located at the substantially 90° or 270° electrical length from the feed point A. In the embodiment of FIGS. 2A, 2B and 2C, the second horizontal conductive portion 220 may be attached at the 270° electrical length from the feed point 2, which is at the 90° electrical length from the ground point 8, providing a 180° difference.

The large size of the ground plane 204 may play a role in antenna performance. For example, the stability of the resonance and radiation pattern may be maintained by securing the termination of the field lines at the ground plane 204. Additionally, the ground plane 204 may act to shield the loop element and the radiating element from electromagnetic disturbances and interferences below, which may cause detuning of the antenna.

The shape and dimensions of each of the feed line 212, the first horizontal conductive portion 216, the second horizontal conductive portion 220 and the vertical conductive portion 224 may be varied depending on target resonant frequencies and bandwidths. For example, the first horizontal conductive portion 216 may be configured to taper out from the point 4 to the point 6 to widen the bandwidth. In another example, the length and/or width of the second horizontal conductive portion 220 may be changed to meet different return loss requirements. Shapes such as meander lines, straight or bent arms, polygonal patches, circles, ovals and combinations thereof can be used to form the conductive portions of the antenna. Furthermore, the overall shape of the substrate 208 and the corresponding ground plane 204 may be configured to be not only a circle but also a square, rectangle, oval and various other shapes. The antenna structure can be modeled with capacitances and inductances associated with the conductive portions with various shapes and dimensions; simulations can be carried out to determine the optimal configuration that meets given requirements such as the target resonant frequency and bandwidth.

The pair of horizontal conductive portions are printed on the dielectric substrate 208 in the example of FIGS. 2A, 2B and 2C. Alternatively, the pair of horizontal conductive portions may be formed along the horizontal plane from a more rigid material without a substrate. In this case, air may be a dielectric present between the pair of horizontal conductive portions and the ground plane 204. Another three-dimensional dielectric material, such as ceramic, alumina, styrofoam, etc., may be used in between the pair of horizontal conductive portions and the ground plane 204 to support the pair of horizontally conductive portions and to maintain the positioning of the pair of horizontally conductive portions relative to the ground plane 204.

Figure 3:
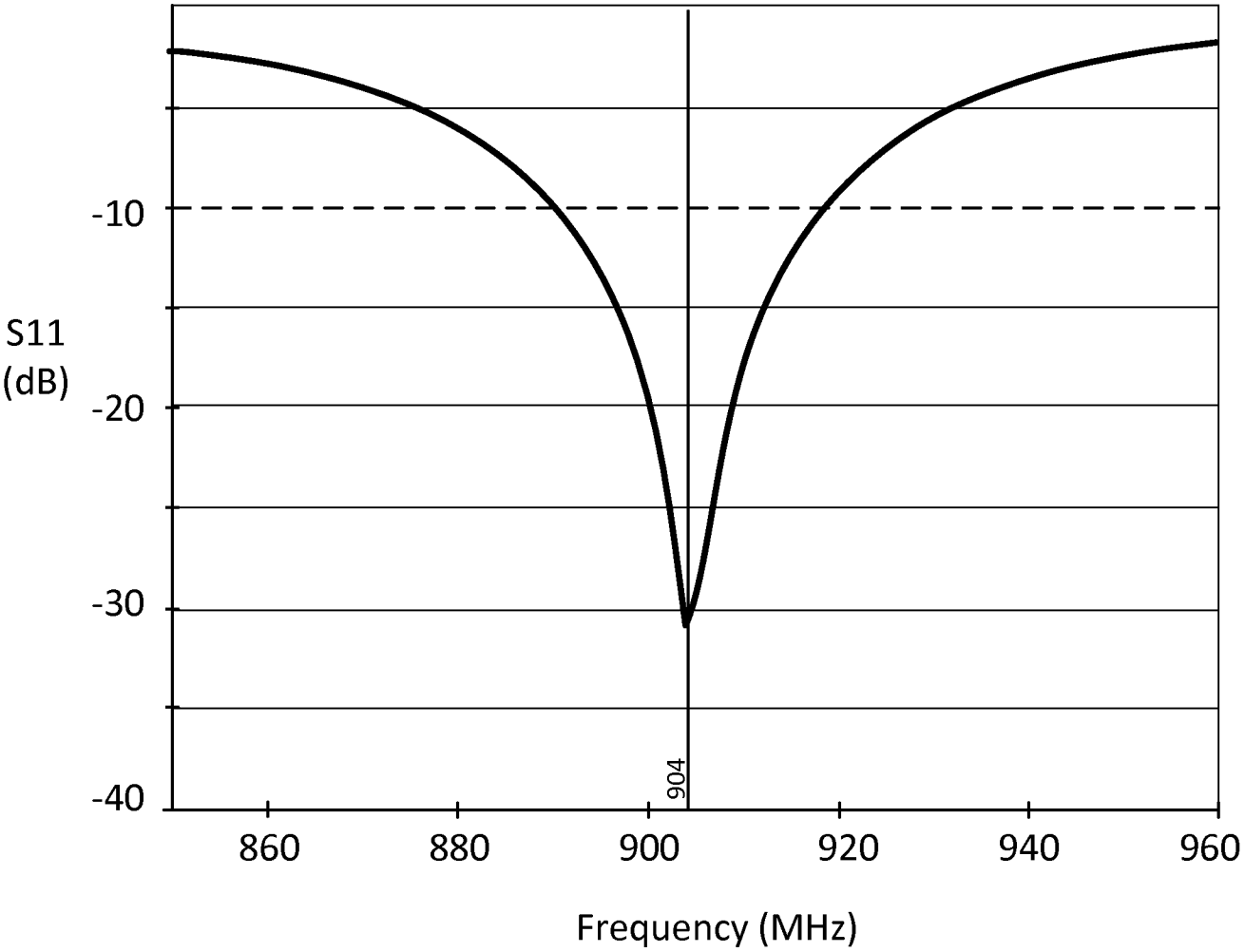
FIG. 3 is a plot showing the return loss (S11 in dB) as a function of frequency (MHz) of the 3D CPL antenna configured as illustrated in FIGS. 2A, 2B and 2C.

FIG. 3 is a plot showing the return loss (S11 in dB) as a function of frequency (MHz) of the 3D CPL antenna, configured as illustrated in FIGS. 2A, 2B and 2C, having the substrate 208 of an approximate 3.2 inch diameter, the ground plane 204 of an approximate 5 inch diameter and the total height of approximately 0.5 inch. The shapes and dimensions of the conductive portions are determined to provide a 900 MHz resonance, which may be suitable for certain water meter applications. The present 3D CPL antenna is referred to herein as being of low profile since a typical quarter-wave monopole antenna has to be over 3 inches tall to generate a resonance at ~900 MHz, versus the approximate 0.5 inch height of the embodiment disclosed herein.

Figure 4B:
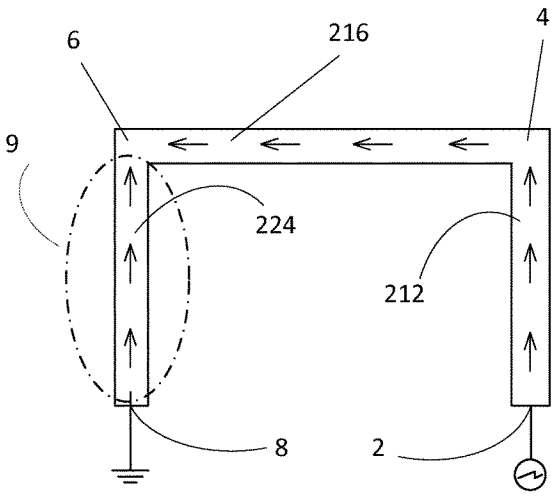
FIG. 4B illustrates directions of local currents at the resonant frequency along the vertical cross section including the feed line, the vertical conductive portion and the first horizontal conductive portion.
Figure 4A:
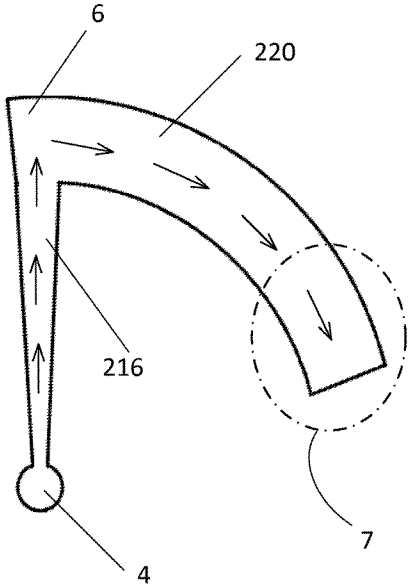
FIG. 4A illustrates directions of local currents at the resonant frequency along the first and second horizontal conductive portions.

FIG. 4A illustrates directions of local currents at the resonant frequency along the first and second horizontal conductive portions 216 and 220. FIG. 4B illustrates directions of local currents at the resonant frequency along the vertical cross section including the feed line 212, the vertical conductive portion 224 and the first horizontal conductive portion 216. The directions of all the local currents may be configured to be reversed, providing equivalent electromagnetic effects. It is observed that the fed currents from the feed point 2 move up along the feed line 212, reach the point 4, move horizontally along the first horizontal conductive portion 216, and reach the point 6; the currents from the ground also move up along the vertical portion 224, and reach the point 6. At this point, the currents are directed along the second horizontal conductive portion 220 to reach the open end portion of the second horizontal conductive portion 220. Therefore, a high E field is generated around the open end portion as indicated by a dot-dash line 7 in FIG. 4A, and the second horizontal conductive portion 220 functions similar to a monopole radiator, much like the radiating element 120 of the planar CPL antenna 100 of FIG. 1. The vertical loop as outlined by point 2, point 4, point 6, and point 8 FIG. 4B is configured to have the local currents high in magnitude along the vertical conductive portion 224, giving rise to a high H field as indicated by a dot-dash line 9 in FIG. 4B.

As mentioned earlier, the E and H fields are generated substantially orthogonal to each other by virtue of the 90°/270° placement of the radiating element, i.e., the second horizontal conductive portion 220, to the loop element, i.e., the vertical loop as outlined by point 2, point 4, point 6, and point 8 having the feed line 212, the vertical conductive portion 224, and the first horizontal conductive portion 216. Furthermore, in this embodiment, the local currents of high magnitude are generated around the open end portion of the second horizontal conductive portion 220 and around the vertical conductive portion 224, giving rise to comparable, high magnitudes of the E and H fields. Therefore, high radiation efficiency can be obtained by using the present 3D CPL antenna configured to provide the Poynting vector E×H optimized by the orthogonal relationship and the comparable, high |H| and |E| in magnitude, wherein the Poynting vector E×H is a direct measure of the radiated power, and thus the radiation efficiency.

Figure 5:
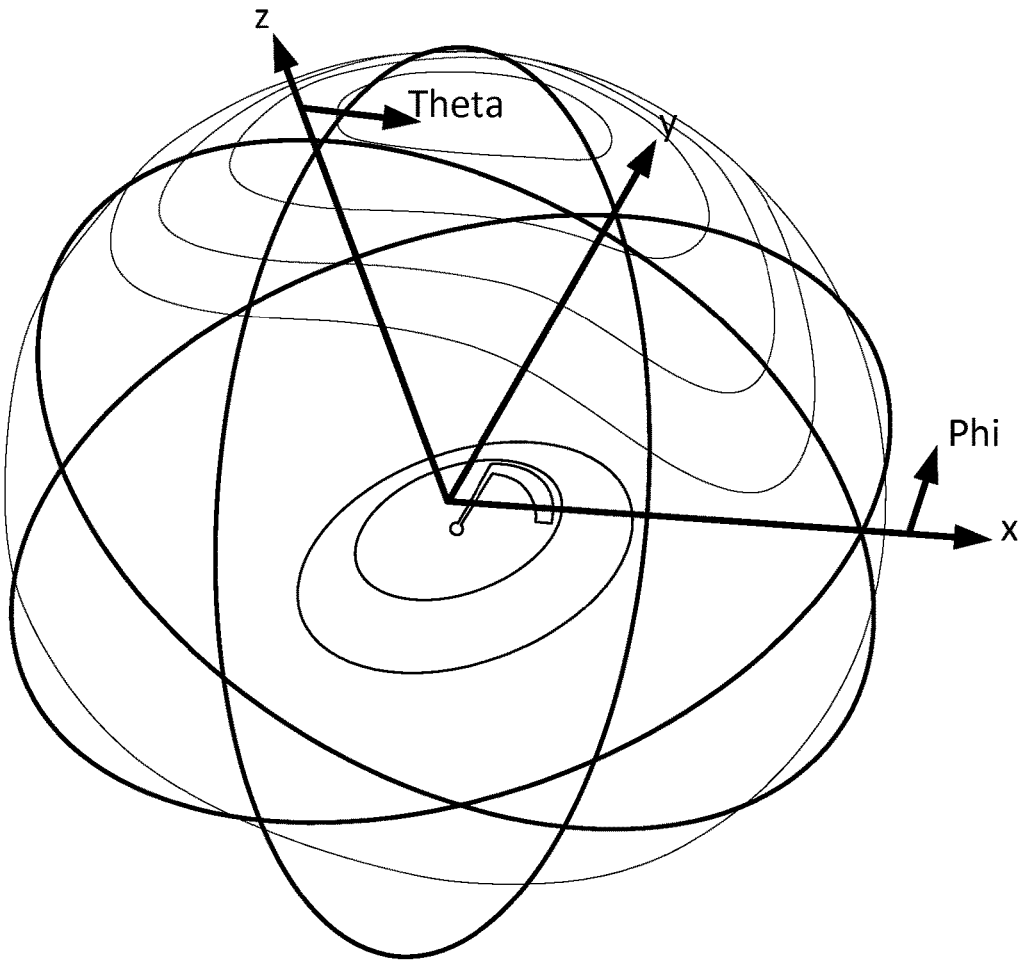
FIG. 5 is a plot showing a farfield radiation pattern at the resonant frequency of the 3D CPL antenna illustrated in FIGS. 2A, 2B and 2C.

FIG. 5 is a plot showing a farfield radiation pattern at the resonant frequency of the 3D CPL antenna illustrated in FIGS. 2A, 2B and 2C. It is observed that the radiation is directional substantially toward the Z-direction, i.e., the vertical direction, much like a monopole antenna.

Figure 6B:
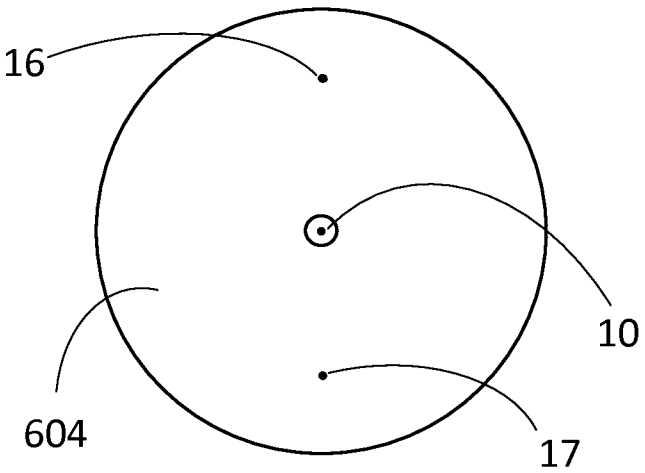
FIG. 6B illustrates a bottom view of the 3D CPL antenna structure illustrated in FIG. 6A.
Figure 6A:
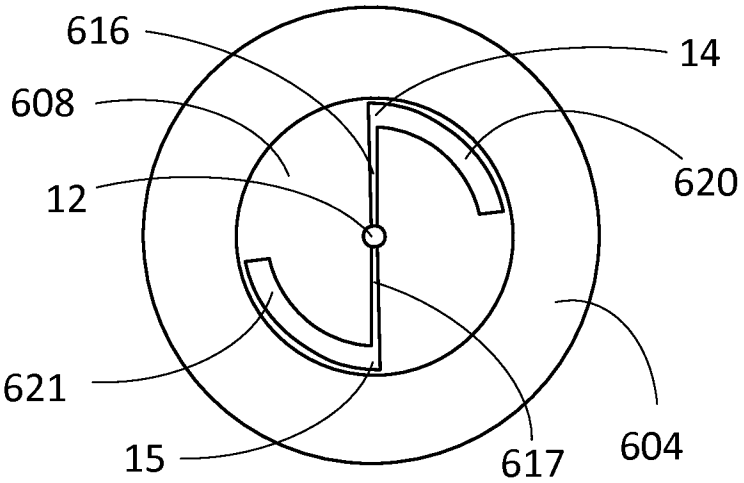
FIG. 6A illustrates a top view of an embodiment of a 3D CPL antenna structure.
Figure 6C:
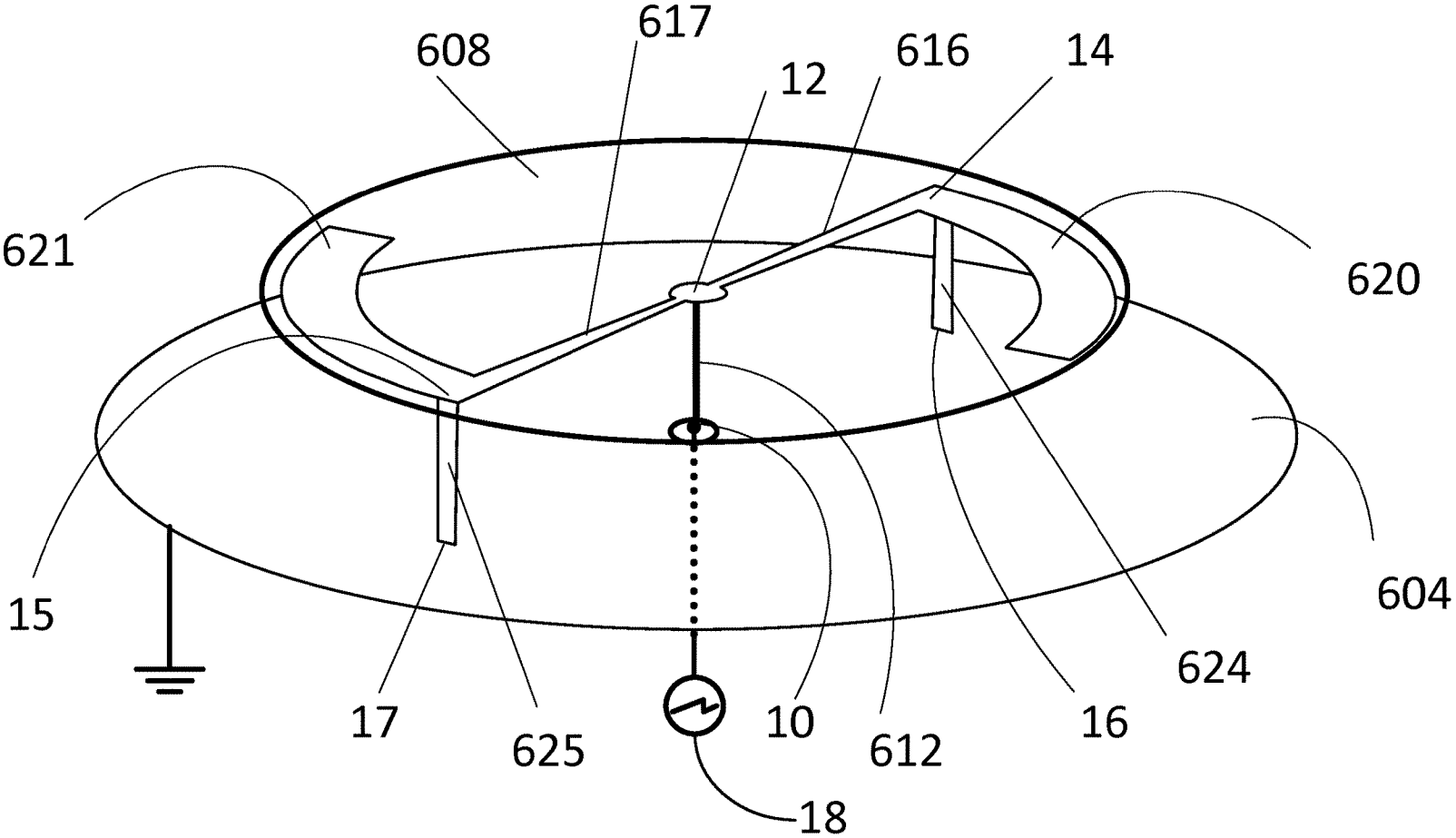
FIG. 6C illustrates a front perspective view of the 3D CPL antenna structure illustrated in FIG. 6A.

FIGS. 6A, 6B and 6C illustrate another embodiment of a 3D CPL antenna structure: FIG. 6A is a top view, FIG. 6B is a bottom view and FIG. 6C is a front perspective view. Conductive patches and traces are shown by shading in the figures. This 3D CPL antenna includes a ground plane 604 and a pair of horizontal conductive portions printed on a substrate 608, which may be placed along a horizontal plane (X-Y plane) (relative to ground plane 604) and made of a dielectric material such as a PCB, ceramic, alumina, etc. The 3D CPL antenna may further include vertical conductive portions formed vertical (along the Z direction) to the ground plane 604 and the substrate 608. In this embodiment, each of the ground plane 604 and the dielectric substrate 608 may be configured to have a shape of a circular disk, and the diameter of the ground plane 604 may be larger than the diameter of the substrate 608. The ground plane 604 and the substrate 608 may be placed substantially in parallel and concentric to each other around the common cylindrical axis, which is also a vertical axis (Z axis) for the embodiment illustrated in FIGS. 6A, 6B and 6C. In the embodiment of FIGS. 2A, 2B and 2C, the first and second horizontal conductive portions 216 and 220 together form a pair of horizontal conductive portions having a shape of a bent arm or scythe printed on the substrate 208. In the embodiment of FIGS. 6A, 6B and 6C, the four horizontal conductive portions form two pairs of horizontal conductive portions, each having a shape of a bent arm or scythe, printed on the substrate 608. A current source 18 is coupled to a feed point 10, which may be located substantially at the center of but isolated from the ground plane 604. A feed line 612 may be formed vertically along the cylindrical axis, coupling the feed point 10 to a point 12, which may be located substantially at the center of the substrate 608.

A first horizontal conductive portion 616 may be coupled to the feed line 612 around the point 12, and extend radially to a point 14, which may be located close to the edge of the substrate 608. A second horizontal conductive portion 620 may be coupled to the first horizontal conductive portion 616 near the point 14, and extend azimuthally along a first periphery of the substrate 608 to span a first predetermined angle. Thus, the first and second horizontal conductive portions 616 and 620 together may form a first pair of horizontal conductive portions having a shape of a bent arm or scythe printed on the substrate 608. In this example, a second pair of horizontal conductive portions having a shape of a bent arm or scythe may be formed, extending opposite in direction on the substrate 608. Namely, a third horizontal conductive portion 617 may be coupled to the feed line 612 around the point 12, and extend radially to a point 15, which may be located close to the edge of the substrate 608. A fourth horizontal conductive portion 621 may be coupled to the third horizontal conductive portion 617 near the point 15, and extend azimuthally along a second periphery of the substrate 608 to span a second predetermined angle. Thus, the first and second horizontal conductive portions 616 and 620 may together form a first pair of horizontal conductive portions having a shape of a first bent arm or scythe printed on the substrate 608, and the third and fourth conductive portions 617 and 621 may together form a second pair of horizontal conductive portions having a shape of a second bent arm or scythe printed on the substrate 608.

The shapes and dimensions of the two bent arms may be configured to be substantially the same or different. The first and second bent arms may be formed radially opposite to each other by rotating one arm by 180° with respect to the other arm around the cylindrical axis (point 12). One end of a first vertical conductive portion 624 may be coupled to the first and second horizontal conductive portions 616 and 620 at a portion having the point 14, and the other end may be shorted to the ground plane 604 around a point 16. One end of a second vertical conductive portion 625 may be coupled to the third and fourth horizontal conductive portions 617 and 621 at a portion having the point 15, and the other end may be shorted to the ground plane 604 around a point 17.

Similar to the planar CPL antenna illustrated in FIG. 1 and the 3D CPL antenna having one bent arm illustrated in FIGS. 2A, 2B and 2C, in order to have the E and H fields orthogonal to each other, the second horizontal conductive portion 620 may be coupled to a portion having the point 14 that is located at a substantially 90° or 270° electrical length from the feed point 10. Similarly, the fourth horizontal conductive portion 621 may be coupled to a portion having the point 15 that is located at a substantially 90° or 270° electrical length from the feed point 10.

Similar to the case of the 3D CPL antenna having one bent arm illustrated in FIGS. 2A, 2B and 2C, the large size of the ground plane 604 may play a role in antenna performance. For example, the stability of the resonance and radiation pattern may be maintained by securing the termination of the field lines at the ground plane 604. Additionally, the ground plane 604 may act to shield the loop element and the radiating element from electromagnetic disturbances and interferences below, which may cause detuning of the antenna.

The shape and dimensions of each of the feed line 612, two vertical conductive portions 624 and 625, and the four horizontal conductive portions 616, 617, 620 and 621 may be varied depending on target resonant frequencies and bandwidths. For example, the first and third horizontal conductive portion 616 and 617 may be configured to taper out from the point 12 to the points 14 and 15, respectively, to widen the bandwidth. In another example, the length and/or width of the second and fourth horizontal conductive portions 620 and 621 may be changed to meet different return loss requirements. Shapes such as meander lines, straight or bent arms, polygonal patches, circles, ovals and combinations thereof can be used to form the conductive portions of the antenna. Furthermore, the overall shape of the substrate 608 may be configured to be not only circle but also square, rectangle, oval and various others. The antenna structure can be modeled with capacitances and inductances associated with the conductive portions with various shapes and dimensions; simulations can be carried out to determine the optimal configuration that meets given requirements such as the target resonant frequency and bandwidth.

The pairs of horizontal conductive portions may be printed on the dielectric substrate 608 in the example of FIGS. 6A, 6B and 6C. Alternatively, the pairs of horizontal conductive portions may be formed along the horizontal plane of a more rigid self-supporting material so as to eliminate the need for the substrate. In this case, air may be a dielectric presence between the pairs of horizontal conductive portions and the ground plane 604. Another three-dimensional dielectric material, such as ceramic, alumina, STYROFOAM, etc., may be used in-between the pairs of horizontal conductive portions and the ground plane 604 to help support the pairs of horizontally conductive portions and to help maintain the relative positioning between the pairs of horizontally conductive portions and the ground plane.

Figure 7:
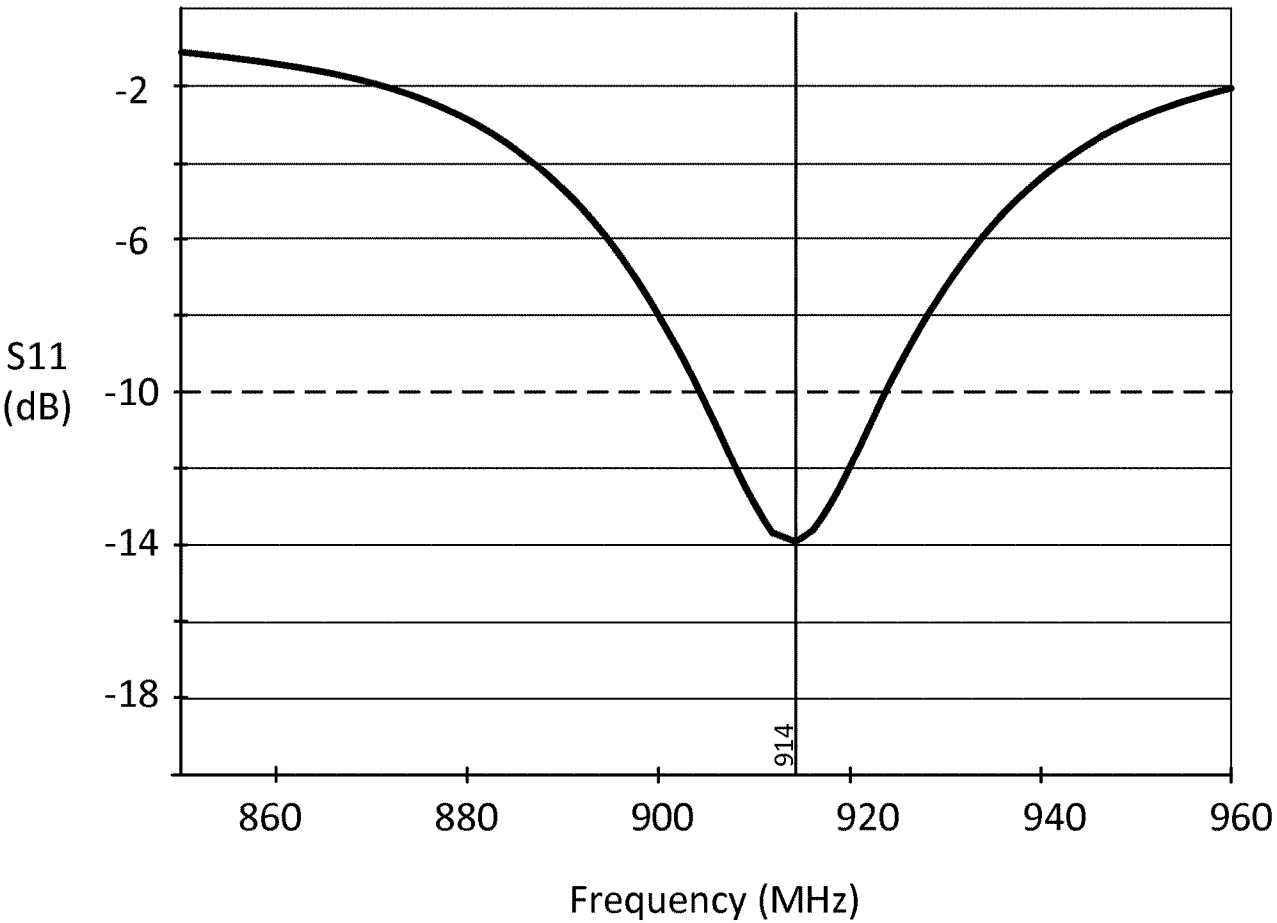
FIG. 7 is a plot showing the return loss (S11 in dB) as a function of frequency (MHz) of the 3D CPL antenna having two bent arms, configured as illustrated in FIGS. 6A, 6B and 6C.

FIG. 7 is a plot showing the return loss (S11 in dB) as a function of frequency (MHz) of the 3D CPL antenna having two bent arms, configured as illustrated in FIGS. 6A, 6B and 6C, having the substrate 608 of an approximate 3.2 inch diameter, the ground plane 604 of an approximate 5 inch diameter and the total height of approximately 0.5 inch. The shapes and dimensions of the conductive portions may be determined to provide the 900 MHz resonance, which may be suitable for certain water meter applications. The present 3D CPL antenna having an approximate 0.5 inch height is considered to be of low profile, since a typical quarter-wave monopole antenna has to be over 3 inches tall to generate a resonance at ~900 MHz.

Figure 8B:
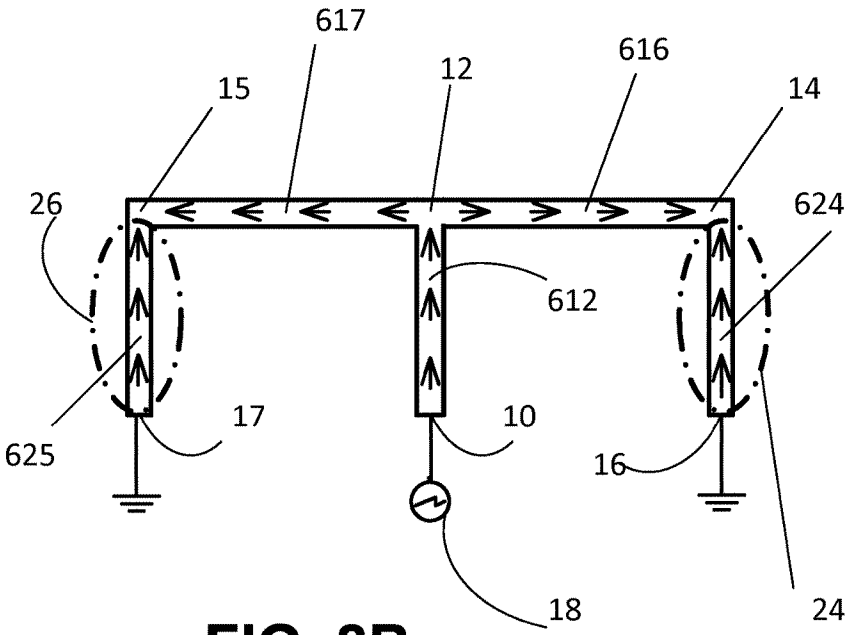
FIG. 8B illustrates directions of local currents at the resonant frequency along the vertical cross section including the feed line, first and second vertical conductive portions, and the first and third horizontal conductive portions.
Figure 8A:
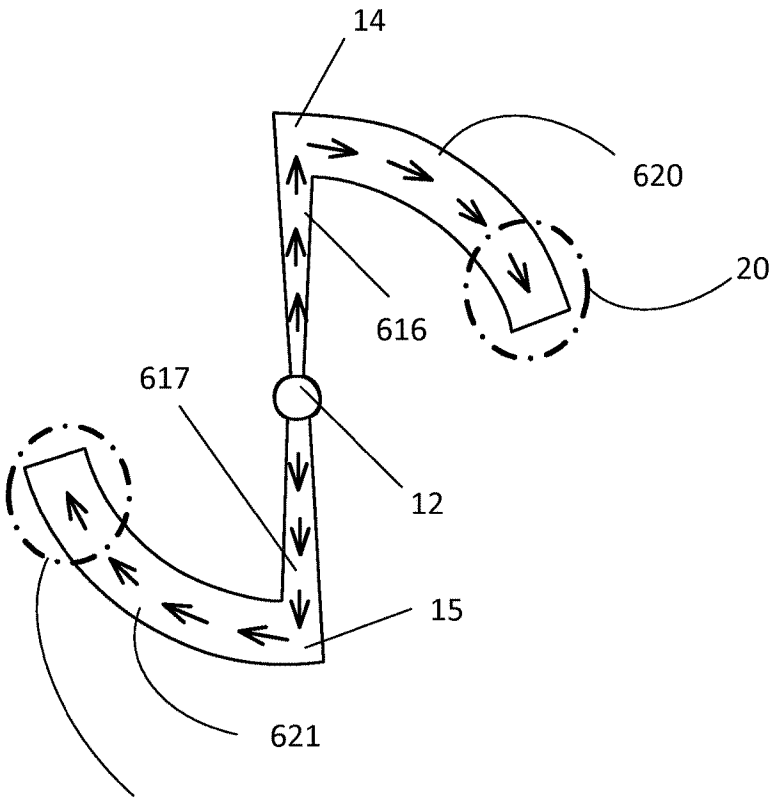
FIG. 8A illustrates directions of local currents at the resonant frequency along the first-fourth horizontal conductive portions.

FIG. 8A illustrates directions of local currents at the resonant frequency along the first-fourth horizontal conductive portions 616, 620, 617 and 621. FIG. 8B illustrates directions of local currents at the resonant frequency along the vertical cross section including the feed line 612, the first and second vertical conductive portions 624 and 625, and the first and third horizontal conductive portions 616 and 617. The directions of all the local currents may be configured to be reversed, providing equivalent electromagnetic effects. It is observed that the fed currents from the feed point 10 move up along the feed line 612, reach the point 12, move horizontally and radially along the first and third horizontal conductive portions 616 and 617 and reach the points 14 and 15, respectively; the currents from the ground also move up along the first and second vertical portion 624 and 625 and reach the points 14 and 15, respectively.

At the point 14, the currents flowing along the first horizontal conductive portion 616 and along the first vertical conductive portion 624 are directed along the second horizontal conductive portion 620 to reach the open end portion of the second horizontal conductive portion 620. At the point 15, the currents flowing along the third horizontal conductive portion 617 and along the second vertical conductive portion 625 are directed along the fourth horizontal conductive portion 621 to reach the open end portion of the fourth horizontal conductive portion 621. Therefore, high E fields may be generated around the two open end portions as indicated by a dot-dash line 20 and dot-dash line 22 in FIG. 8A, and the second and fourth horizontal conductive portion 620 and 621 function similar to dipole radiators. The vertical loop as outlined by point 10, point 12, point 14, and point 16 and the vertical loop as outlined by point 10, point 12, point 15, and point 17 in FIG. 8B may be configured to have the local currents high in magnitude along the first and second vertical conductive portions 624 and 625, giving rise to high H fields as indicated by a dot-dash line 24 and dot-dash line 26 in FIG. 8B, respectively.

As mentioned earlier, the E and H fields may be generated substantially orthogonal to each other by virtue of the 90°/270° placement of the radiating element, i.e., the second horizontal conductive portion 620, to the loop element, i.e., the vertical loop as outlined by point 10, point 12, point 14, and point 16 having the feed line 612, the first vertical conductive portion 624 and the first horizontal conductive portion 616, and similarly by virtue of the 90°/270° placement of the other radiating element, i.e., the fourth horizontal conductive portion 621, to the other loop element, i.e., the vertical loop as outlined by point 10, point 12, point 15, and point 17 having the feed line 612, the second vertical conductive portion 625 and the third horizontal conductive portion 617. Furthermore, in this embodiment, the local currents of high magnitude are generated around the two open end portions of the second and fourth horizontal conductive portion 620 and 621, and around the first and second vertical conductive portion 624 and 625, giving rise to comparable, high magnitudes of the E and H fields. Therefore, high radiation efficiency may be obtained by using the present 3D CPL antenna configured to provide the Poynting vector E×H optimized by the orthogonal relationship and the comparable, high |H| and |E| in magnitude, wherein the Poynting vector E×H is a direct measure of the radiated power, and thus the radiation efficiency.

Referring back to FIGS. 6A, 6B and 6C, the 3D CPL antenna may include two pairs of horizontal conductive portions, each having a shape of a bent arm or scythe, formed on the substrate 608, the first pair of horizontal conductive portions having the first horizontal conductive portion 616 and the second horizontal conductive portion 620, and the second pair of horizontal conductive portions having the third horizontal portion 617 and the fourth horizontal conductive portion 621. The first and second bent arms or scythes may be configured to have the same shape and dimensions and formed radially opposite to each other by rotating one arm by 180° with respect to the other arm around the cylindrical axis (point 12).

As can be seen from the current directions illustrated in FIG. 8A, the first and third horizontal conductive portions 616 and 617, respectively, have the currents radially opposite to each other, and the second and fourth horizontal conductive portions 620 and 621, respectively, have the currents azimuthally opposite to each other. Therefore, this embodiment has the overall current along the horizontal substrate plane cancelling out each other, and the vertical currents along the first and second vertical conductive portions 624 and 625 adding up in phase. As a result, the radiation is vertically polarized due to the overall current direction that is vertical, and is omnidirectional on the horizontal plane due to the placement of the two bent arms or scythes by a 180° rotation from each other around the point 12. Furthermore, since the currents on the horizontal plane cancel out, the electromagnetically sensitive areas are isolated to the vertical conductive portions. Thus, the above radial placement of the pairs of horizontal conductive portions effectively shields the vertical conductive portions from electromagnetic disturbances and interferences. Together with the ground plane that acts to shield the sensitive areas from electromagnetic disturbances and interferences below, the present 3D CPL antenna may be configured to be resilient to external detuning effects.

Figure 9:
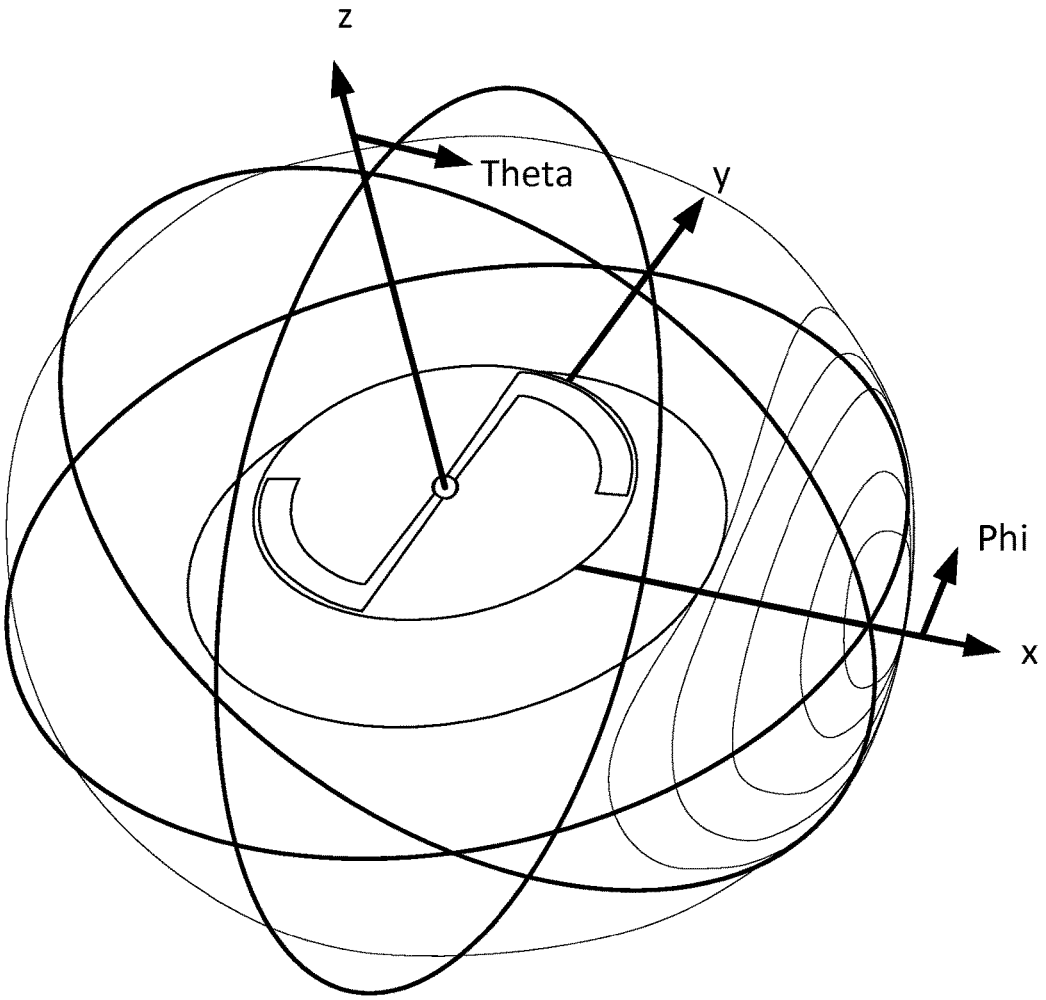
FIG. 9 is a plot showing a farfield radiation pattern at the resonant frequency of the 3D CPL antenna having two bent arms illustrated in FIGS. 6A, 6B and 6C.

FIG. 9 is a plot showing a farfield radiation pattern at the resonant frequency of the 3D CPL antenna having two bent arms illustrated in FIGS. 6A, 6B and 6C. It is observed that the radiation is omnidirectional on the X-Y plane, i.e., the horizontal plane, much like a dipole antenna.

Figure 10C:
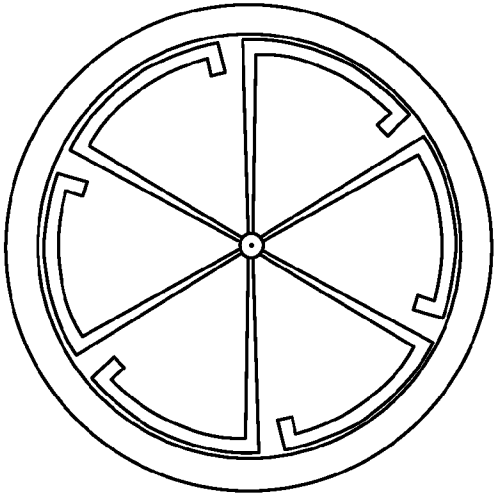
FIG. 10C illustrates a top view of an embodiment of a 3D CPL antenna structure with six arms.
Figure 10B:
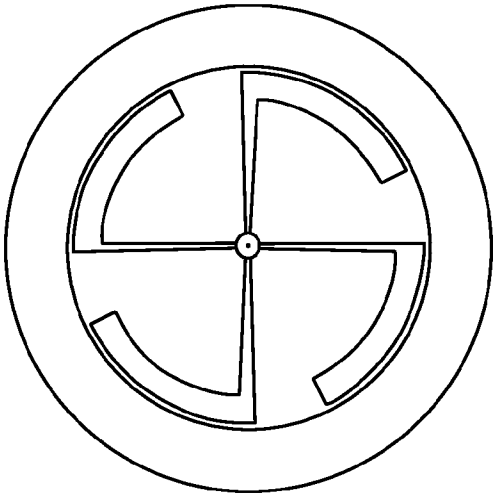
FIG. 10B illustrates a top view of an embodiment of a 3D CPL antenna structure with four arms.
Figure 10A:
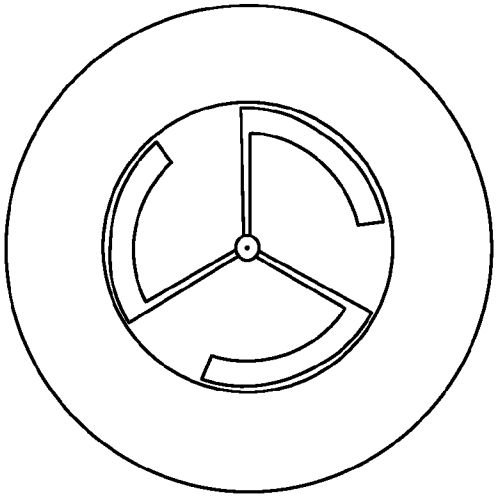
FIG. 10A illustrates a top view of an embodiment of a 3D CPL antenna structure with three arms.

Embodiments of the 3D CPL antennas are illustrated in FIGS. 2A, 2B and 2C and FIGS. 6A, 6B and 6C, having one bent arm and two bent arms on the substrate, respectively. The 3D CPL antenna having three or more arms may be configured. FIGS. 10A, 10B and 10C are separate and distinct embodiments of top views illustrating 3D CPL antennas having three arms, four arms and six arms, respectively. Based on the illustrations of FIGS. 2A, 2B and 2C and 6A, 6B and 6C, it should be understood that these arms may be formed on the substrate that may be placed along the horizontal plane (relative to the ground plane), the center of the horizontal plane may be vertically coupled to the feed point, and a vertical conductive portion may be formed for each arm at a location near the edge to couple to the ground plane. The shape and dimensions of each arm may be configured in a wide variety of ways using meander lines, straight or bent arms, polygonal patches, circles, ovals and combinations thereof. Furthermore, the overall shape of the substrate may be configured to be not only circle but also square, rectangle, oval and various other shapes.

The pairs of horizontal conductive portions may be printed on the dielectric substrate in the examples of FIGS. 10A, 10B and 10C. Alternatively, the pairs of horizontal conductive portions may be formed along the horizontal plane without a substrate. In this case, air may be a dielectric presence between the pairs of horizontal conductive portions and the ground plane. Another dielectric, such as ceramic, alumina, styrofoam, etc., may be used in between the pairs of horizontal conductive portions and the ground plane to maintain the relative positioning. The number of arms may be even or odd. When an even number of arms are formed on the substrate in such a way that each pair has two arms placed radially opposite to each other, as the two arms illustrated in FIGS. 6A, 6B and 6C, the horizontal currents along the horizontal plane cancel out each other, and the vertical currents along the vertical conductive portions add up in phase, as explained earlier with reference to FIGS. 8A and 8B. As a result, in such embodiments, the radiation is vertically polarized and omnidirectional on the horizontal plane.

Figure 11:
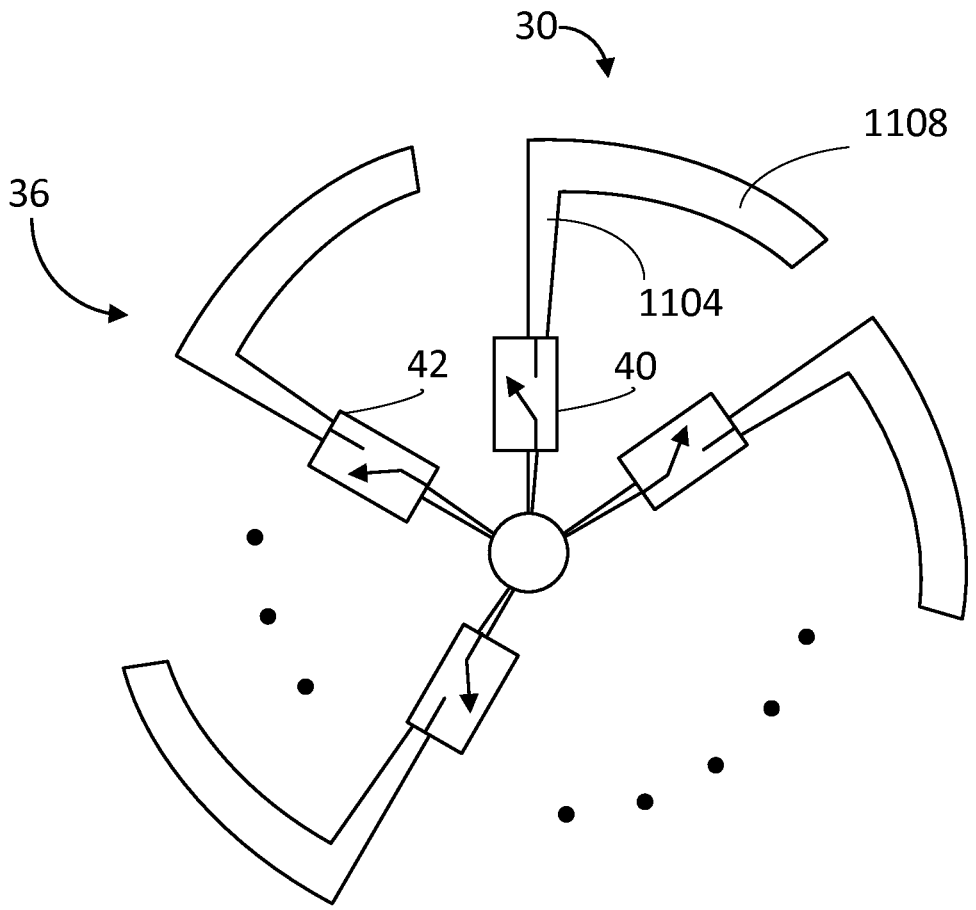
FIG. 11 is a top view illustrating an embodiment of a 3D CPL antenna having multiple arms formed on the substrate and associated switches.

In the 3D CPL antennas thus far presented herein, the radiation properties, such as polarization and directivity, depend on the number of arms formed on the substrate. An embodiment of a multi-radiation pattern antenna may be configured by incorporating switches with the 3D CPL antenna having multiple arms. FIG. 11 is a top view illustrating an embodiment of the 3D CPL antenna having multiple arms formed on the substrate and multiple switches respectively associated with the arms. As illustrated in FIG. 11, arm 30, which has switch 40, may be a first arm and arm 36, which has switch 42, may be arm n, where n is any number of arms (n is at least 4 as shown in FIG. 11). In this example, each arm may be placed by an angle rotation around the cylindrical axis from the adjacent arm (the angle may be predetermined), and includes a first conductive portion (e.g., first conductive portion 1104) radially extending from the center to the edge portion of the substrate and a second conductive portion (e.g., first conductive portion 1108) azimuthally extending along a periphery of the substrate to span an angle that may be predetermined. Based on the illustrations of FIGS. 2A, 2B and 2C and 6A, 6B and 6C, it should be understood that these arms may be formed on the substrate that may be placed along the horizontal plane, the center of the horizontal plane may be vertically coupled to the feed point, and a vertical conductive portion may be formed for each arm at a location near the edge to couple to the ground plane. The shapes and dimensions of the arms may be configured to be the same or different from each other. The shape and dimensions of each arm may be configured in a wide variety of ways using meander lines, straight or bent arms, polygonal patches, circles, ovals and combinations thereof. Furthermore, the overall shape of the substrate may be configured to be not only circle but also square, rectangle, oval and various others.

The pairs of horizontal conductive portions may be printed on the dielectric substrate in the example of FIG. 11. Alternatively, the pairs of horizontal conductive portions may be formed along the horizontal plane without a substrate. In this case, air may be a dielectric present between the pairs of horizontal conductive portions and the ground plane. Another dielectric, such as ceramic, alumina, styrofoam, etc., may be used in between the pairs of horizontal conductive portions and the ground plane to maintain the relative positioning. Additionally, the separation angles between adjacent arms may be the same or different. The number of arms may be even or odd. The present embodiment may include a switch coupled to the first conductive portion of each arm, such as first conductive portion 1104. The switches, such as switch 40 and switch 42, may be coupled to the arms, such as arm 30 and arm 36, and the ON/OFF may be individually controlled by a controller. This embodiment allows for generation of multiple radiation patterns by selecting one or more switches to turn on to couple the one or more associated arms to the feed point, while the other switches are turned off.

Figure 12B:
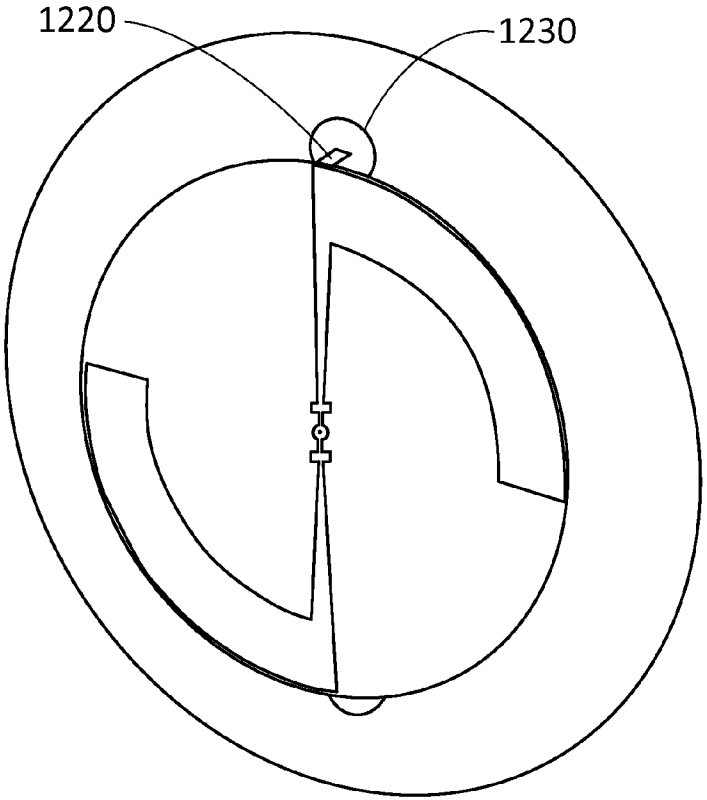
FIG. 12B is a perspective view of the antenna of FIG. 12A.
Figure 12A:
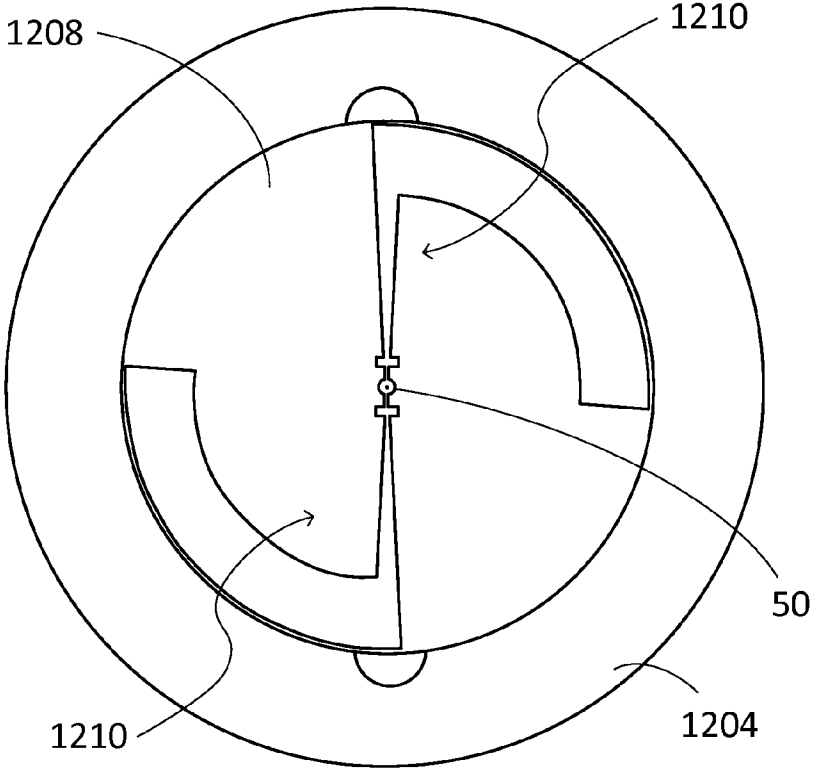
FIG. 12A is a top view of a 3D CPL antenna with two horizontal conductive pairs and capacitive grounding.

FIGS. 12A and 12B illustrate another embodiment of a 3D CPL antenna structure that is substantially similar to the embodiment illustrated in FIGS. 6A, 6B and 6C, the description for which largely applies to this embodiment as well. FIG. 12A is a top view and FIG. 12B is a perspective view. Conductive patches and traces are shown in the figures. This 3D CPL antenna includes a ground plane 1204 and a pair of horizontal conductive portions printed on a substrate 1208. The 3D CPL antenna may further include vertical conductive portions formed vertical to the ground plane 1204 and the substrate 1208. The four horizontal conductive portions form two pairs of horizontal conductive portions 1210, each having a shape of a bent arm or scythe, printed on the substrate 1208. A current source is coupled to a feed point 50 by a feed line (not shown).

Figure 13:
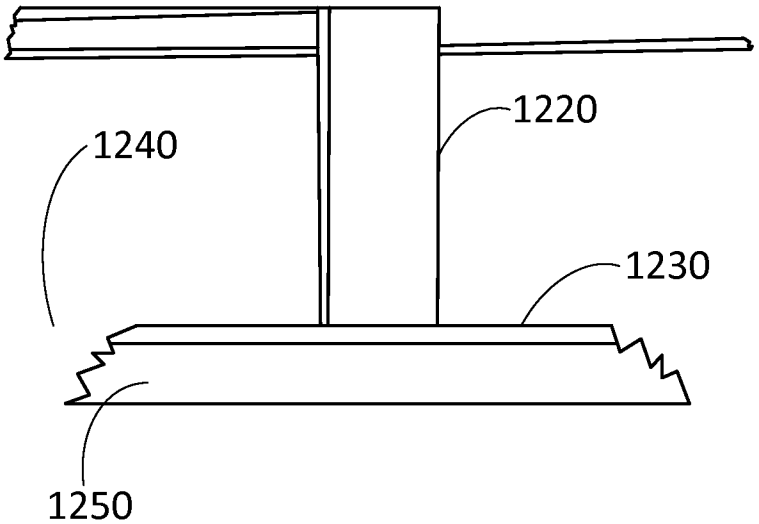
FIG. 13 is a partial side view of a vertical conductive portion of the antenna of FIGS. 12A and 12B illustrating the capacitive grounding of the loop.

The pairs of horizontal conductive portions 1210 are in turn coupled to the feed line around the point 50, and extend outwardly from point 50 as described with respect to FIG. 6. As shown in FIG. 12B, and more clearly in FIG. 13, a vertical conductive portion 1220 connects each of the pairs of horizontal conductive portions 1210 to a capacitive grounding patch 1230, which is positioned on a substrate 1240 that physically separates the grounding patch 1230 from the ground plane 1250, but still permits for capacitive grounding between the grounding patch 1230 and the ground plane 1250. Grounding the magnetic loop created by the combination of the feed line, one portion of the pair of horizontal conductive portion 1210 and the vertical conductive portion 1230 may add the LC components necessary to improve return loss match of the antenna and to improve efficiency.

Figure 14:
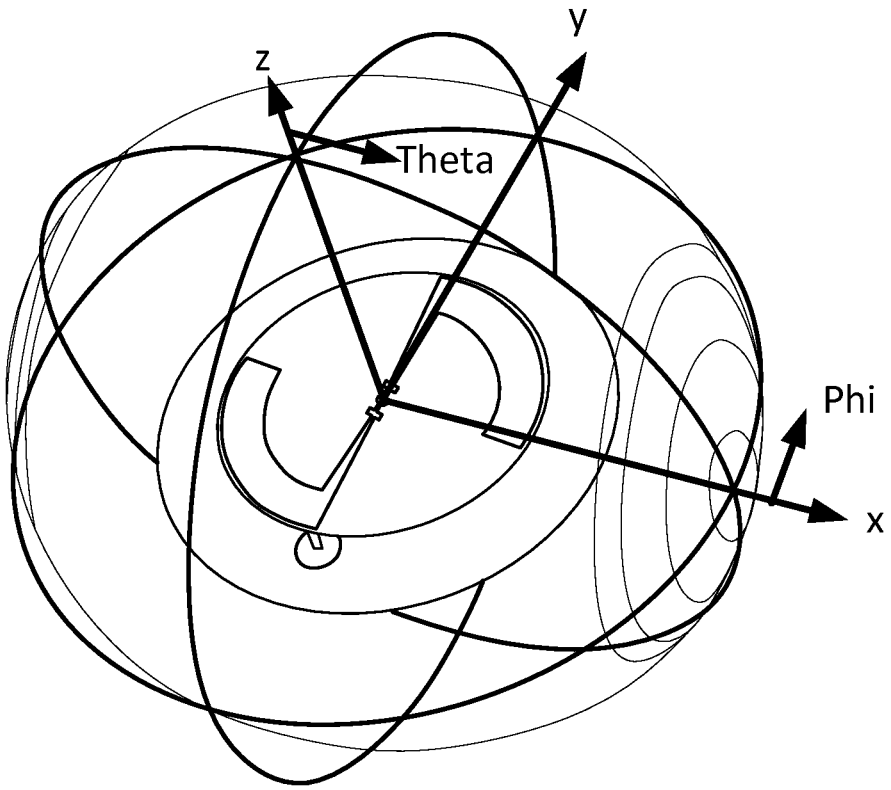
FIG. 14 is a plot showing a farfield radiation pattern at the resonant frequency of the 3D CPL antenna illustrated in FIGS. 12A and 12B.

FIG. 14 is a plot showing a farfield radiation pattern at the resonant frequency of the 3D CPL antenna illustrated in FIGS. 12A and 12B. The farfield pattern's polarization is set by the number of radiation elements. As there are two oppositely positioned radiating elements, the radiation is bidirectional and, in this case, positioned around and along the X-axis.

Figure 15:
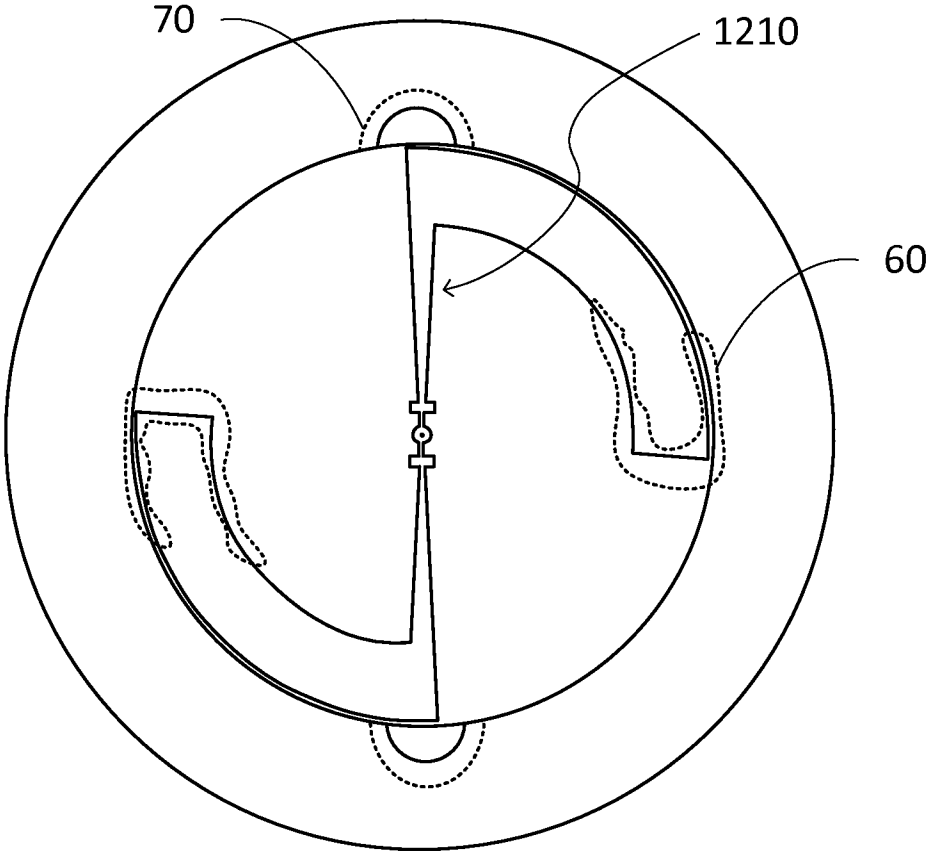
FIG. 15 is an E-field plot illustrating a top view of the E-field radiation patterns of the antenna of FIG. 12A.

FIG. 15 is an E-field plot illustrating a top view of the E-field radiation patterns of the antenna of FIG. 12A. FIG. 15 illustrates the directions of local currents at the resonant frequency along the pairs of horizontal conductive portions 1210. In this embodiment, a high E field is generated around the open end portion as indicated by a dot-dash lines 60 near the end of the radiating elements of the pair of horizontal conductive portions 1210 and the dot-dash line 70 along the vertically conductive portions (not shown in FIG. 15) and the ground patches 1230.

Figure 16:
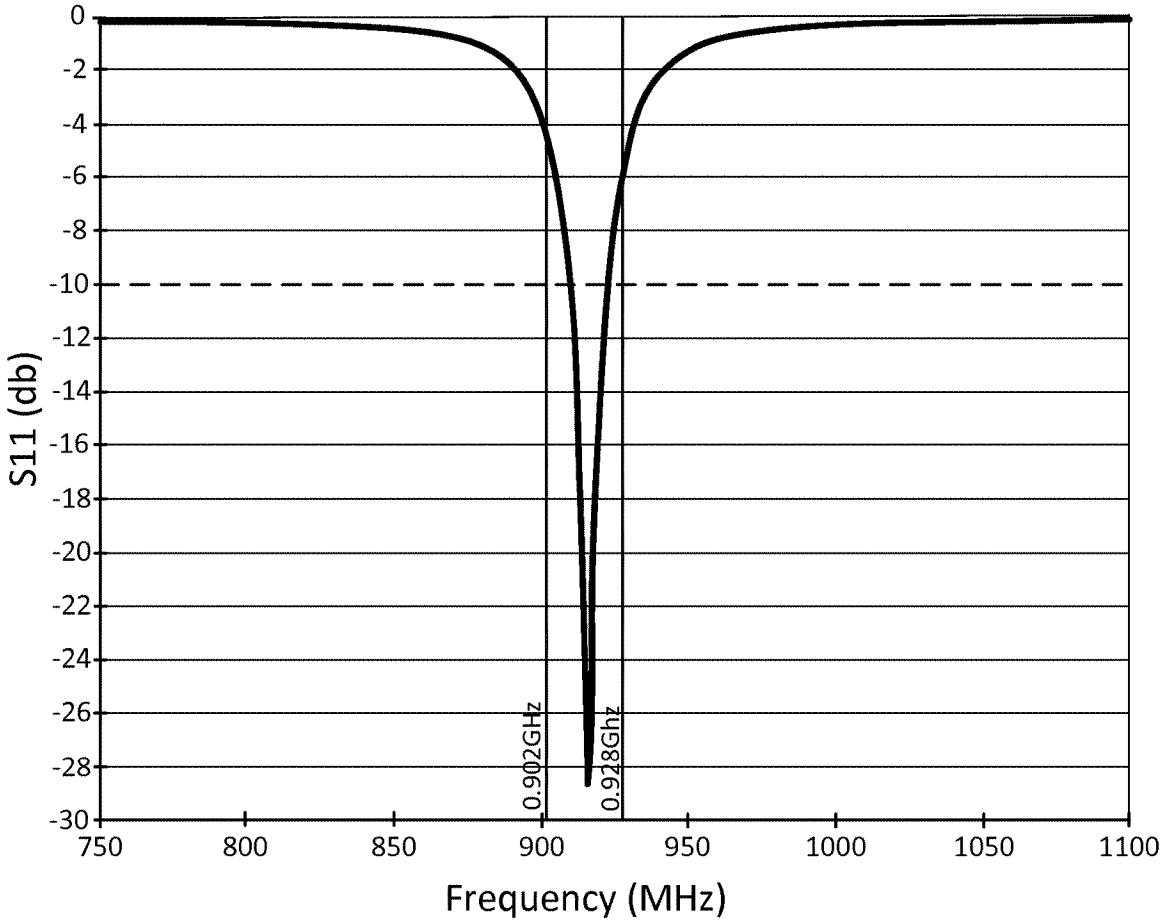
FIG. 16 is a plot showing the return loss (S11 in dB) as a function of frequency (MHz) of the antenna configured as illustrated in FIGS. 12A and 12B.

FIG. 16 is a plot showing the return loss (S11 in dB) as a function of frequency (MHz) of the antenna configured as illustrated in FIGS. 12A and 12B.

In an embodiment, an antenna comprises: a ground plane situated on a first plane having a first side and a second side; a substantially vertical feed line coupled to a power source on the first side, the feed line passing through to the second side but electrically isolated from the ground plane; at least a pair of substantially horizontal conductive portions on a second plane different from the first plane and including a first portion and a second portion, the first portion having a first end coupled to the feed line and a second end coupled to an end of the second portion; and at least one substantially vertical conductive portion having a first end and a second end, the first end of the vertical conductive portion being coupled to the second end of the of the first portion, the second end of the vertical conductive portion being coupled to the ground plane, wherein the vertical feed line, the first portion and the vertical conductive portion are configured to form a loop generating a H-field, wherein the second portion is configured to emit an E-field, and wherein the H-field and the E-field are substantially orthogonal.

In the embodiment, wherein the second portion is coupled with the loop at a substantially 90° or 270° electrical length from a feed point of the feed line. In the embodiment, the ground plane is configured to be confined within a first area and the pair of horizontal conductive portions is configured to be contained within a second area smaller than the first area. In the embodiment, wherein the first area, the second area, or both the first area and the second area, is substantially a shape of a circle or oval. In the embodiment, wherein the first area, the second area, or both the first area and the second area, is substantially a shape of a polygon.

In the embodiment, wherein the pair of horizontal conductive portions are configured to be self-supporting and wherein air forms a dielectric between the pair of horizontal conductive portions and the ground plane. In the embodiment, wherein the pair of horizontal conductive portions are configured to be formed on a dielectric substantially filling an area between the pair of horizontal conductive portions and the ground plane.

In the embodiment, wherein the pair of horizontal conductive portions are formed on a substrate. In the embodiment, wherein the substrate is a dielectric. In the embodiment, wherein the substrate is substantially a circular shape, wherein the first portion is configured to extend radially from the first end of the first portion toward the second end of the first portion, wherein the first end of the first portion is located near a center of the circular shape, wherein the second end of the first portion is located close to an edge of the substrate, wherein the second portion is configured to be coupled to the first portion at a point located at a substantially 90° or 270° electrical length along the loop from a feed point of the feed line, and wherein the second portion is configured to extend azimuthally along a periphery of the substrate. In the embodiment, wherein the substrate is substantially a circular shape, wherein the first portion is configured to extend radially from the first end of the first portion toward the second end of the first portion, wherein the first end of the first portion is located near a center of the circular shape, wherein the second end of the first portion is located close to an edge of the substrate, wherein the second portion is configured to be coupled to the first portion at a point along the loop where current flowing through the loop is at a reflective minimum, and wherein the second portion is configured to extend azimuthally along a periphery of the substrate.

In the embodiment, further comprising a switch coupled between the first end of the first portion and the feed line. In the embodiment, wherein the switch is configured to be controlled by a controller to selectively electrically connect the first portion to the feed line to selectively generate a radiation pattern.

In the embodiment, wherein the ground plane is formed on or within a substrate, further comprising a ground patch formed on the substrate, wherein the ground patch is not physically coupled to the ground plane but is coupled to the second end of the vertical conductive portion and is capacitively coupled to the ground plane. In the embodiment, wherein the ground plane is configured as an electromagnetic shield for the feed line, the pair of horizontal conductive portions, and the vertical conductive portion. In the embodiment, wherein the ground plane is configured to reduce detuning effects to the antenna.

In the embodiment, wherein there is a first pair of horizontal conductive portions operating with a first vertical conductive portion and a second pair of horizontal conductive portions operating with a second vertical conductive portion, and wherein the first pair of horizontal conductive portions and the first vertical conductive portion are positioned substantially opposite on the second plane from the second pair of horizontal conductive portions and the second vertical conductive portion. In the embodiment, wherein the ground plane is formed on or within a substrate, further comprising a first ground patch and a second ground patch formed on the substrate, wherein the first ground patch and the second ground patch are not physically coupled to the ground plane but are coupled respectively to the second end of the first vertical conductive portion and the second vertically conductive portion and are capacitively coupled to the ground plane.

In the embodiment, wherein there is a plurality of pairs of horizontal conductive portions each operating with a vertical conductive portion, and wherein the plurality of pairs of horizontal conductive portions and corresponding vertical conductive portion are symmetrically arranged around the second plane. In the embodiment, further comprising a plurality of switches each coupled between the first end of the first portion of the each pair of horizontal conductive portions among the plurality of pairs of the horizontal conductive portions and the feed line, and wherein the plurality of switches are configured to be controlled by a controller to selectively electrically connect the first portion of each pair of horizontal conductive portions to the feed line to selectively generate a radiation pattern.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed:

1. An antenna, comprising:

a ground plane situated on a first plane having a first side and a second side;

a substantially vertical feed line coupled to a power source on the first side, the feed line passing through to the second side but electrically isolated from the ground plane;

at least a pair of substantially horizontal conductive portions on a second plane different from the first plane, each of the at least a pair of substantially horizontal conductive portions including a first portion and a second portion, the first portion having a first end coupled to the feed line and a second end coupled to an end of the second portion); and at least one substantially vertical conductive portion having a first end and a second end, the first end of the vertical conductive portion being coupled to the second end of the of the first portion, the second end of the vertical conductive portion being coupled to the ground plane, wherein the vertical feed line, the first portion and the vertical conductive portion are configured to form a loop generating a H-field, wherein the second portion is configured to emit an E-field, and wherein the H-field and the E-field are substantially orthogonal.

2. The antenna of claim 1, wherein the second portion is coupled with the loop at a substantially 90° or 270° electrical length from a feed point of the feed line.

3. The antenna of claim 1, wherein the ground plane is configured to be confined within a first area and the pair of horizontal conductive portions is configured to be contained within a second area smaller than the first area.

4. The antenna of claim 3, wherein the first area, the second area, or both the first area and the second area is substantially a shape of a circle or oval.

5. The antenna of claim 3, wherein the first area, the second area, or both the first area and the second area is substantially a shape of a polygon.

6. The antenna of claim 1, wherein the pair of horizontal conductive portions are configured to be self-supporting and wherein air forms a dielectric between the pair of horizontal conductive portions and the ground plane.

7. The antenna of claim 6, wherein the pair of horizontal conductive portions are configured to be formed on a dielectric substantially filling an area between the pair of horizontal conductive portions and the ground plane.

8. The antenna of claim 1, wherein the pair of horizontal conductive portions are formed on a substrate.

9. The antenna of claim 8, wherein the substrate is a dielectric.

10. The antenna of claim 8, wherein the substrate is substantially a circular shape, wherein the first portion is configured to extend radially from the first end of the first portion toward the second end of the first portion, wherein the first end of the first portion is located near a center of the circular shape, wherein the second end of the first portion is located close to an edge of the substrate, wherein the second portion is configured to be coupled to the first portion at a point located at a substantially 90° or 270° electrical length along the loop from a feed point of the feed line, and wherein the second portion is configured to extend azimuthally along a periphery of the substrate.

11. The antenna of claim 8, wherein the substrate is substantially a circular shape, wherein the first portion is configured to extend radially from the first end of the first portion toward the second end of the first portion, wherein the first end of the first portion is located near a center of the circular shape, wherein the second end of the first portion is located close to an edge of the substrate, wherein the second portion is configured to be coupled to the first portion at a point along the loop where current flowing through the loop is at a reflective minimum, and wherein the second portion is configured to extend azimuthally along a periphery of the substrate.

12. The antenna of claim 1, further comprising a switch coupled between the first end of the first portion and the feed line.

13. The antenna of claim 12, wherein the switch is configured to be controlled by a controller to selectively electrically connect the first portion to the feed line to selectively generate a radiation pattern.

14. The antenna of claim 1, wherein the ground plane is formed on or within a substrate, further comprising a ground patch formed on the substrate, wherein the ground patch is not physically coupled to the ground plane but is coupled to the second end of the vertical conductive portion and is capacitively coupled to the ground plane.

15. The antenna of claim 1, wherein the ground plane is configured as an electromagnetic shield for the feed line, the pair of horizontal conductive portions, and the vertical conductive portion.

16. The antenna of claim 1, wherein the ground plane is configured to reduce detuning effects to the antenna.

17. The antenna of claim 1, wherein there is a first pair of horizontal conductive portions operating with a first vertical conductive portion and a second pair of horizontal conductive portions operating with a second vertical conductive portion, and wherein the first pair of horizontal conductive portions and the first vertical conductive portion are positioned substantially opposite on the second plane from the second pair of horizontal conductive portions and the second vertical conductive portion.

18. The antenna of claim 17, wherein the ground plane is formed on or within a substrate, further comprising a first ground patch and a second ground patch formed on the substrate, wherein the first ground patch and the second ground patch are not physically coupled to the ground plane but are coupled respectively to the second end of the first vertical conductive portion and the second vertically conductive portion and are capacitively coupled to the ground plane.

19. The antenna of claim 1, wherein there is a plurality of pairs of horizontal conductive portions each operating with a vertical conductive portion, and wherein the plurality of pairs of horizontal conductive portions and corresponding vertical conductive portion are symmetrically arranged around the second plane.

20. The antenna of claim 19, further comprising a plurality of switches each coupled between the first end of the first portion of the each pair of horizontal conductive portions among the plurality of pairs of the horizontal conductive portions and the feed line, and wherein the plurality of switches are configured to be controlled by a controller to selectively electrically connect the first portion of each pair of horizontal conductive portions to the feed line to selectively generate a radiation pattern.

* * * * *